US005943076A

United States Patent [19]

Burke et al.

[11] Patent Number: 5,943,076

[45] Date of Patent: Aug. 24, 1999

[54] PRINTHEAD FOR THERMAL INK JET DEVICES

[75] Inventors: Cathie J. Burke, Rochester; Michael P. O'Horo, Fairport; Donald J. Drake, Rochester; Alan D. Raisanen, Sodus, all of N.Y.

[73] Assignee: Xerox Corporation, Stamford, Conn.

[21] Appl. No.: 08/805,098

[22] Filed: Feb. 24, 1997

[51] Int. Cl.[6] ..... B41J 2/05

[52] U.S. Cl. ..... 347/64; 438/21; 438/698

[58] Field of Search ..... 347/65, 64, 63, 347/62; 438/21, 698, 760

[56] References Cited

U.S. PATENT DOCUMENTS

| | | | |
|---|---|---|---|
| Re. 32,572 | 1/1988 | Hawkins et al. | 156/626 |
| 4,719,477 | 1/1988 | Hess | 347/59 |
| 4,951,063 | 8/1990 | Hawkins et al. | 347/62 |
| 5,469,200 | 11/1995 | Terai | 347/63 |

OTHER PUBLICATIONS

Michael O'Horo et al., "Effect of TIJ Heater Surface Topology on Vapor Bubble Nucleation," SPIE Journal, pp. 58–64; Jan. 29, 1996; vol. 2658.

*Primary Examiner*—Joseph Hartary

[57] ABSTRACT

The nucleation efficiency of a thermal ink jet printhead is improved by forming a heater element with a planar surface. A heater resistor, polysilicon in a preferred embodiment, has an irregular surface which can trap gas or vapors in the cracks or crevices. When the heater resistor is pulsed, the nucleation temperature is reduced by these trapped vapors requiring an increase in electrical input to the resistors, thereby reducing efficiency. The invention recognizes that a heater resistor with a planar surface in contact with an ink layer results in a higher nucleation temperature and increased efficiency. In one embodiment, a phosphosilicate glass (PSG) is flowed directly onto the resistor surface forming a planarization layer. Subsequent deposition of tantalum substantially replicates the underlying topography creating a heater resistor with a smooth surface adjacent the ink.

In a second embodiment, a diffusion layer which is conformal is formed on the resistor surface with the PSG layer formed on the oxide layer. The diffusion layer can be a pyrolytic CVD deposited silicon nitride or a thermally grown oxide layer. The PSG layer has a planarized surface to which the tantalum conforms.

13 Claims, 3 Drawing Sheets

PRINTHEAD FOR THERMAL INK JET DEVICES

BACKGROUND OF THE INVENTION AND MATERIAL DISCLOSURE STATEMENT

The invention relates generally to thermal ink jet printing and, more particularly, to printheads with resistive heaters provided with improved drop ejection efficiency.

Thermal ink jet printing is generally a drop-on-demand type of ink jet printing which uses thermal energy to produce a vapor bubble in an ink-filled channel that expels a droplet. A thermal energy generator or heating element, usually a resistor, is located in the channels near the nozzle a predetermined distance therefrom. An ink nucleation process is initiated by individually addressing resistors with short (2–6 μ second) electrical pulses to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separating of the bulging ink as a droplet. The acceleration of the ink out of the nozzle while the bubble is growing provides the momentum and velocity of the droplet in a substantially straight line direction towards a recording medium, such as paper.

The environment of the heating element during the droplet ejection operation consists of high temperatures, thermal stress, a large electrical field, and a significant cavitational stress. Thus, the need for a cavitational stress protecting layer over the heating elements was recognized early, and one very good material for this purpose is tantalum (Ta), as is well known in the industry.

It has been demonstrated that nucleation efficiency is dependent upon the properties of the heater surface. (See article by Michael O'Horo et al. entitled "Effect of TIJ Heater Surface Topology on Vapor Bubble Nucleation", SPIE Journal, Vol. 2658, pgs. 58–64, Jan. 29, 1996). In this article, experimental observation showed that vapor bubble nucleation consisted of two types; homogeneous nucleation and heterogeneous nucleation. Homogeneous nucleation occurs in the ink spontaneously when the nucleation temperature is reached. Heterogeneous nucleation usually occurs at surface sites (cracks and crevices) of the resistive heater. The surface sites contain trapped gases or vapors which cause the initiation temperature for heterogeneous nucleation to be considerably lower than that of homogeneous nucleation. The stored energy and consequent efficiency of vapor bubble expansion is significantly reduced.

The preferred material for resistive heaters is polysilicon, or other sputtered resistor materials. Polysilicon is comprised of numerous grains whose size and roughness varies with high temperature cycling and doping levels. Polysilicon surface roughness for a high dose implant heater (heater 2 described in the O'Horo article) is 27.2 nm. The resistive heater is passivated with either a thermally grown oxide layer or pyrolytic CVD deposited silicon nitride, both of which are conformal; e.g. reproduce the polysilicon surface roughness on the surface of the passivation layer. A layer of tantalum is sputtered onto the passivation layer, which substantially replicates the underlying topography, as well as adding some topography due to the Ta grain structure. Therefore, the surface of the tantalum layer reproduces the surface side and hence, roughness of the underlying polysilicon and the nucleation efficiency of a heater structure of this type (polysilicon with passivation layer and tantalum) is not optimum.

From the above, it is evident that a smoother surface of either the polysilicon, or the passivation layer, or the tantalum would increase nucleation efficiency by reducing the number of vapor-trapping cracks or crevices. U.S. Pat. No. 5,469,200 discloses techniques used to polish the heater substrate to improve flatness and, in another example, to form a thermal oxide by oxidizing the substrate surface concurrently with a thermally softening step, resulting in a smoother surface on the oxide passivation layer. These techniques are not entirely satisfactory because of the excessively high temperatures and/or long heating cycles, resulting in incompatibilty with integrated microelectronics circuitry.

SUMMARY OF THE INVENTION

It is, therefore, an object of the present invention to improve the nucleation efficiency of a resistive heater used in thermal ink jet printers by making the surface of the heater non-conformal (smoother) than the surface of the underlying resistor (polysilicon).

In one embodiment of the invention, the surface of the polysilicon heater was planarized by adding a step to the wafer formation process of depositing and reflowing a thin layer of phosphosilicate glass (PSG) onto the surface. The tantalum layer, being deposited on a smoother topography, acquires a smoother surface. This embodiment has the added benefit of doping the polysilicon during reflow, thereby eliminating a processing step for certain structures.

In a second embodiment of the invention, a thin layer of silicon nitride is grown followed by the PSG reflow step. The overlying tantalum retains a smoother topography over the smooth reflowed PSG surface.

More particularly, the present invention relates to a thermal ink jet printhead, a heating resistor for converting electrical energy into thermal energy causing nucleation of ink in operatively associated channels and expelling of ink through nozzles operatively associated with said channels, the resistor including:

a heater substrate, a heater resistor formed on a surface of the heater substrate, a portion of the resistor in thermal communication with ink in said channel, a tantalum layer and at least a planarizing layer between said tantalum layer and said portion of the resistor, whereby the overlying tantalum layer has a smooth planar surface which produces a more effective nucleation of said ink.

In a preferred embodiment, the resistor is polysilicon and the planarizing layer is phosphosilicate glass (PSG).

DESCRIPTION OF THE INVENTION

Figure 1:
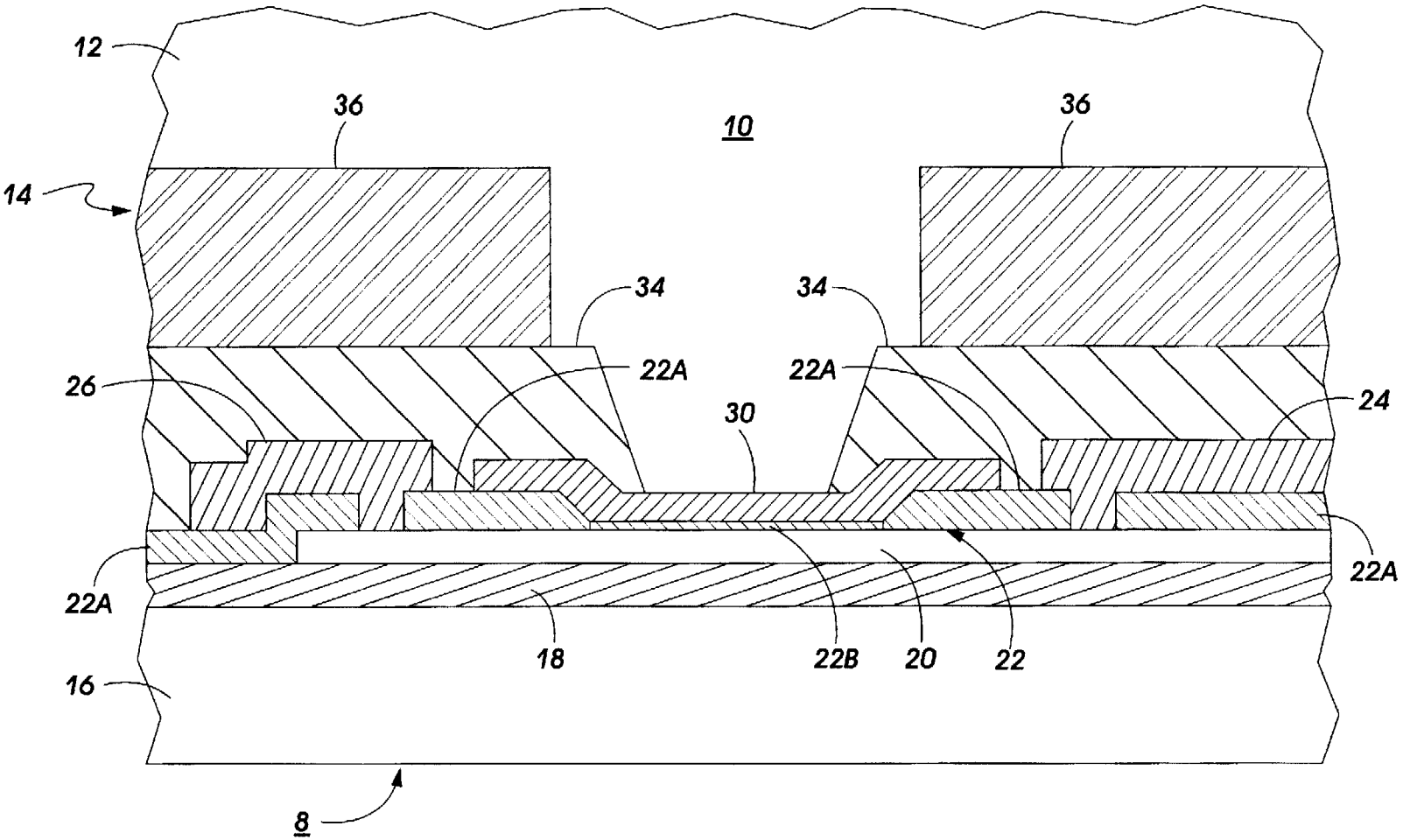
FIG. 1 an enlarged cross-sectional view of a first embodiment of the improved heater resistor of the present invention.

FIG. 1 is a cross-sectional view of a first embodiment of an improved resistive heater structure which can be used, for example, in a printhead of the type disclosed in U.S. Patents Re. 32,572 and 4,951,063, whose contents are hereby incorporated by reference. It is understood that the improved heater structures of the present invention can be used in other types of thermal ink jet printheads where a resistive element is heated to nucleate ink in an adjoining layer.

Referring to FIG. 1, a portion of an ink jet printhead 8 is shown with ink in channel 10 being ejected from nozzle 12 formed in front face 14. Printhead 10 is fabricated by a conventional process (except for the formation of the PSG layer) such as that disclosed in U.S. Patents Re. 32,572 and 4,951,063, referenced supra. A lower silicon substrate 16 has an underglaze layer 18 of thermal oxide. Polysilicon resistors 20 are formed on layer 18. According to the invention, and in a preferred embodiment, a planarization layer of reflowed phosphosilicate glass 22 is formed, the layer having two layers of different thickness. Layers 22A were formed by depositing a 7000 angstroms thick layer of 7.5 wt % P LOTOX™ PSG and reflowing for 90 minutes at 1000° C. in oxygen. Layer 22B was formed by depositing a 500 angstrom thick layer of 7.5 wt % P LOTOX™ PSG and reflowing for 45 minutes at 1000° C. in oxygen. A range of PSG between 500 and 1000 angstroms is effective for providing the smoother surfaces of the invention. Layer 22B penetrates cracks and crevices present in the surface of resistor 20 planarizing the polysilicon. The thicker PSG layers 22A are masked and etched to produce vias at the edges of the resistor for subsequent interconnection to the aluminum addressing electrode 24 and aluminum counter return electrode 26. A tantalum layer 30 is then formed over layer 22B and portions of 22A. Layer 30 substantially replicates the surface of the PSG layer 22B and hence is planarized. A monograph demonstrated that the RMS roughness of the tantalum layer 30 surface was 22.3 nm or about 5 nm less than the 27.2 nm representing the prior art heater RMS roughness.

For electrode passivation, a phosphorous doped CVD silicon dioxide film 34 is deposited followed by a thick film insulative layer 36. Film 34 and layer 36 are formed as described in the '063 patent referenced supra.

Figure 2:
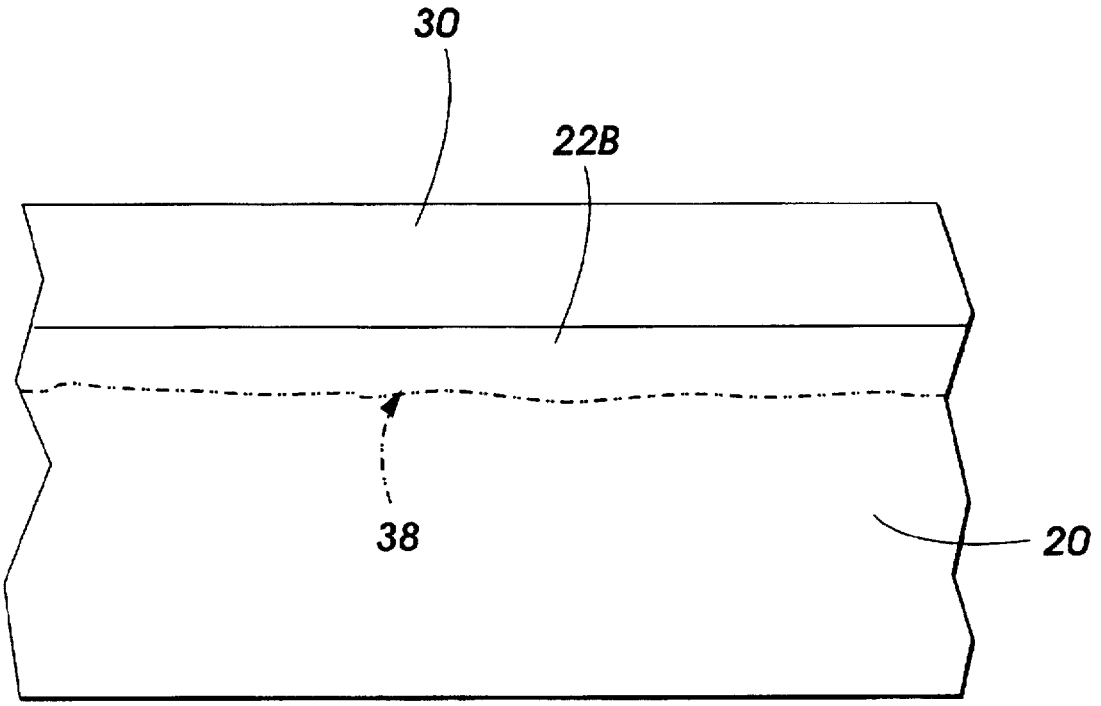
FIG. 2 is a further enlarged cross-sectional view of the resistor of FIG. 1.

Referring to FIG. 2, the reflowed PSG film 22B is shown as filling in the surface sites of the polysilicon resistor and forming a smooth surface which the overlying tantalum replicates. The polysilicon layer 20 may have a sheet resistance in the range of 5 ohms/sq. to 5K ohms/sq. If the particular sheet resistance is in the lower range, an additional doping or diffusion step is ordinarily required in the prior art to decrease the sheet resistance. It is assumed that resistor 20 has a sheet resistance of 18 ohms/square. Phosphorus dopant from the PSG film area 30 diff-uses during the glass reflow step into area 38 of polysilicon region 20. This diffusion decreases the resistivity and eliminates the need for a separate doping step required in the prior ant.

Figure 3:
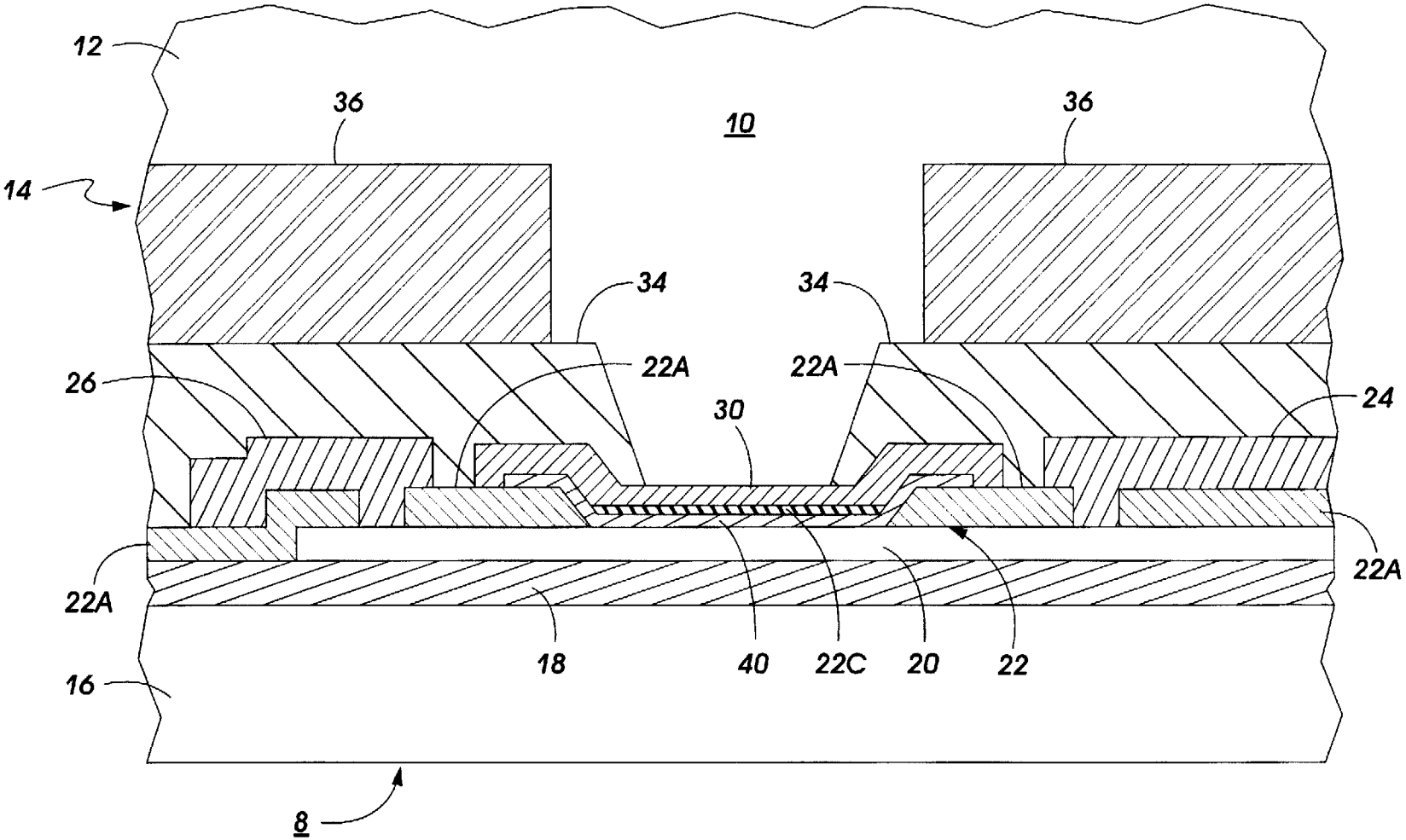
FIG. 3 is an enlarged cross-sectional embodiment of the improved heater resistor of the present invention.

In a second embodiment of the invention shown in FIG. 3, the PSG film is formed over a previously formed diffusion barrier layer 40 which can be a pyrolytic CVD deposited silicon nitride or a thermally grown oxide layer.

For this embodiment, the PSG layers 22A, 22B are formed as previously described. A $S_iO_2$ film 40 is formed as disclosed in the '063 patent. This embodiment may be preferred for cases where the polysilicon resistor 20 is at the higher range of resistivity and, therefore, decreased resistivity by diffusion of the PSG unto the surface is not desirable.

While the embodiment disclosed herein is preferred, it will be appreciated from this teaching that various alternative, modifications, variations or improvements therein may be made by those skilled in the art. For example, the planarization layer may be formed of other reflowable materials such as BPSG (borophosphosilicate glass). All these modifications are intended to be encompassed by the following claims.

We claim:

1. In a thermal ink jet printhead, a heating resistor for converting electrical energy into thermal energy causing nucleation of ink in operatively associated channels and expelling of ink through nozzles operatively associated with said channels, the resistor including:

a heater substrate, a heater resistor formed on a surface of the heater substrate, a portion of the resistor in thermal communication with ink in said channel, a tantalum layer and at least a planarizing layer between said tantalum layer and said portion of the resistor, said planarizing layer having a thickness between 500 and 1000 angstroms, whereby the overlying tantalum layer has a smooth planar surface which produces a more effective nucleation of said ink.

2. The thermal ink jet printhead of claim 1 wherein said resistor is polysilicon and said planarizing layer is phosphosilicate glass (PSG) and wherein said PSG layer is deposited and reflowed on the surface of said polysilicon resistor fling interstices between silicon crystallites resulting in a planar surface.

3. The thermal ink jet printhead of claim 2 further including a diffusion barrier layer formed on the resistor surface and conforming thereto, and wherein the PSG layer is deposited and flowed onto the conforming surface of the diffusion layer creating a planar surface on which said tantalum layer is formed.

4. The thermal ink jet printhead of claim 3 wherein the diffusion barrier layer is silicon nitride.

5. The thermal ink jet printhead of claim 3 wherein the diffusion barrier layer is a thermally grown oxide layer.

6. The printhead of claim 1 wherein said planarizing layer completely covers the surface of the heater resistor.

7. A method for fabricating an improved printhead for use in an ink jet printer, the printhead including a plurality of ink filled channels in thermal communication with at least one portion of a resistive material, comprising the steps of:

(a) forming a layer of resistive material on the surface of a substrate, (b) forming a plurality of ink channels filled with ink in thermal communication with a portion of said resistive material, (c) depositing and flowing onto a surface of at least said portion a material which forms a planarization layer being between 500 and 1000 angstroms thick and (d) forming a tantalum layer on the planarizing layer.

8. The method of claim 7 wherein the resistive material is polysilicon and the planarization material is phosphosilicate glass (PSG).

9. The method of claim 7 further including the step of forming a diffusion barrier overlying the resistive material, the PSG layer being deposited and reflowed on the surface of the diffusion layer.

10. The method of claim 9 wherein the diffusion layer is silicon nitride.

11. The method of claim 9 wherein the diffusion layer is a thermally grown oxide layer.

12. A method for fabricating an improved printhead for use in an ink jet printer, the printhead including a plurality of ink filled channels in thermal communication with at least one portion of a resistive material, comprising the steps of:

(a) forming a layer of resistive material on the surface of a substrate, (b) growing an oxide layer on a top surface of said resistive material layer, (c) depositing and flowing onto at least the portion of said oxide layer in thermal communication with said ink channels a planarization layer of a reflowable material of between 500 and 1000 angstroms thickness and (d) forming a tantalum layer on the planarization layer, the tantalum surface substantially replicating the planar surface of the underlying planarization layer.

13. The method of claim 12 wherein the resistive material is polysilicon and the reflowable material is phosphosilicate glass (PSG).

* * * * *